US005870858A

United States Patent [19]

Manuel

[11] Patent Number: 5,870,858

[45] Date of Patent: Feb. 16, 1999

[54] CHRISTMAS TREE STAND

[76] Inventor: J. Edward Manuel, R.R. #4 Box 122 A, Claremont, N.H. 03743

[21] Appl. No.: 639,029

[22] Filed: Apr. 16, 1996

Related U.S. Application Data

[63] Continuation of Ser. No. 145,384, Oct. 28, 1993, abandoned.

[51] Int. Cl.[6] ..... A47G 7/02; A47G 33/12

[52] U.S. Cl. ..... 47/40.5; 248/519; 248/523

[58] Field of Search ..... 47/40.5; 248/519, 248/523, 524, 188.2, 514, 515, 528

[56] References Cited

U.S. PATENT DOCUMENTS

| | | | |
|---|---|---|---|
| 1,372,777 | 3/1921 | Samuel et al. | 47/40.5 |
| 1,694,815 | 6/1928 | Garlick . | |
| 1,810,853 | 6/1931 | Ray et al. | 248/523 |
| 2,605,067 | 7/1952 | Lindsell . | |
| 2,617,617 | 11/1952 | Krastel et al. | 47/40.5 |
| 2,883,133 | 4/1959 | Zarate | 248/519 |
| 2,905,414 | 9/1959 | Zierden . | |
| 2,913,202 | 11/1959 | Meldrum | 47/40.5 |
| 3,661,349 | 5/1972 | DeVries . | |
| 4,007,901 | 2/1977 | Mancini et al. | 47/40.5 |
| 4,156,323 | 5/1979 | Scheffler | 47/40.5 |
| 4,436,272 | 3/1984 | Lile . | |
| 4,825,586 | 5/1989 | Coppedge . | |
| 4,901,971 | 2/1990 | Connelly . | |
| 4,913,395 | 4/1990 | Juhas . | |
| 4,967,508 | 11/1990 | Reynolds . | |
| 4,993,176 | 2/1991 | Spinosa | 47/40.5 |
| 5,000,414 | 3/1991 | Rosato . | |
| 5,137,246 | 8/1992 | Idso | 248/523 |
| 5,157,868 | 10/1992 | Munoz | 47/40.5 |
| 5,301,462 | 4/1994 | Hronyetz | 47/40.5 |
| 5,375,808 | 12/1994 | Roy | 47/40.5 |

FOREIGN PATENT DOCUMENTS

| | | | |
|---|---|---|---|
| 1676536 | 9/1991 | U.S.S.R. | 47/79 V |

OTHER PUBLICATIONS

Brochure from Country Line Limited, 4543 Taylor Lane, Warrensville Heights, Ohio 44128.

*Primary Examiner*—Terry Lee Melius
*Assistant Examiner*—Joanne C. Downs

[57] ABSTRACT

A Christmas tree stand that enables a user to adjust the vertical alignment of the tree by him/herself. A unique gimbals arrangement is provided that permits adjustment in one plane while the other plane can be fixed. The verticality position is set by merely turning two easily turnable knobs that are tightened against tilt locking plates which are connected to supporting legs that make up the gimbals. Also, the stand has a single bolt attachment mechanism for locking the tree within the stand. A water indicator apparatus that is hung over the side of the stand enables the user to determine the amount of water within the stand without the need for crawling under the tree.

16 Claims, 8 Drawing Sheets

CHRISTMAS TREE STAND

CROSS REFERENCES TO RELATED APPLICATIONS

This patent is based upon an application which is a continuation of my application Ser. No. 08/145,384 filed Oct. 28,1993, now abandoned.

BACKGROUND

1. Field of Invention

The invention relates to stands for holding Christmas trees, either real or artificial, in a stable, essentially vertical position for decorating and display.

2. Description of Prior Art

Even though putting up and decorating the Christmas tree is only a once-a-year activity, the "putting-up" part is traditionally an annoyingly frustrating task, because prior art tree stands have not been designed to make the job easy. The reason it's so difficult with prior art tree stands is because the same screws that are used to attach the stand to the tree are also used to adjust the tree to a vertical position.

Depending on the particular tree stand used, the number of screws requiring adjustment can be anywhere from three to eight. Moreover, real Christmas trees vary considerably in trunk size depending on tree height and species selected as well as random variations from tree to tree, and the multiplicity of screws can require considerable adjustment time. Also, one or more of the adjusting screws frequently can encounter knots or bulges which cause the screw to be off center, which can result in the tree not being held firmly by the stand. Additionally, the small diameter screws that are used penetrate the tree trunk, making it even more difficult to align the tree to vertical.

The adjustment process traditionally requires one person to lie under the tree and try various adjustment combinations, while others watch the effects and offer suggestions regarding verticality. And when the job is done—usually by mutual consent that "it's close enough"—what's left is a tree that's not very securely attached to a stand that in itself is not a very stable or rigid platform.

And frequently the small loads placed on the tree while it's being decorated will shift it off of its near-vertical far enough to require another round of readjustment.

Present commercially available tree stands also contribute to the problem of inadequately watered trees. The most popular stands feature shallow basins to hold water which quickly evaporates in the warm, low humidity air within the room. Further, the amount of water can only be determined by again lying on the floor to view or feel the status of the basin. And because there is no water level indicator, filling frequently results in overfilling.

In response to these well recognized problems a plethora of solutions have been proposed over the years.

U.S. Pat. No. 2,905,414, issued to Zierden on Sep. 22, 1959, discloses a four point anchoring system with a pin at the base to hold the trunk. The alignment/attachment screws feature rounded ends to prevent cutting into the tree and to accommodate variations in roundness of the tree trunk.

U.S. Pat. No. 4,825,586, issued to Coppedge on May 2, 1989, discloses another four point arrangement, in which magnets are proposed to hold clamping plates at the end of each adjustment/attachment screw.

Still another four point arrangement is disclosed in U.S. Pat. No. 4,967,508, issued to Reynolds on Nov. 6, 1990. A pad is shown connected to the adjustment/attachment screws via a ball and socket arrangement to permit motion between the pad and screw to accommodate the variations encountered with Christmas tree trunks sizes and shapes.

All of the above suffer from the same problem, that is, the multiple attachment screws are also used for adjusting the vertical positioning of the tree.

U.S. Pat. No. 4,901,971, issued to Connelly on Feb. 20, 1991, discloses a single point clamping mechanism utilizing an angled plate with a free-floating rectangular push plate. If a tree with a bulge occurring at a point substantially lower than the location of the screw on the push plate is encountered, it is evident that the screw/push plate arrangement will easily jam and the tree will not be held securely. In order to adjust the vertical position of the tree, the legs must be adjusted using four wing nuts holding two independently adjustable legs. Clearly, vertical adjustment cannot be accomplished while the tree is in the stand since the full weight of the tree will be borne by the adjusting wing nuts.

U.S. Pat. No. 1,694,815, issued to Garlick on Jun. 20,1922, discloses the use of thumb screws at different elevations to hold the trunk. Vertical adjustment is accomplished by adjustment thumb screws at the end of the supporting legs. Again, this adjustment must be done with the full weight of the tree bearing on the adjustment mechanism.

U.S. Pat. No. 4,436,272, issued to Lile et al. on Mar. 13, 1984, discloses the use of two opposing clamps. As in the Connelly disclosure, variations in tree trunk roundness can result in clamping plates to be applied unevenly thus causing the screws to jam. Vertical adjustment is accomplished by inconveniently located leveling feet at the ends of the supporting arms.

U.S. Pat. No. 4,913,395, issued to Juhas on Apr. 3, 1990, discloses a gimbaled bracket structure so that the tree can be adjusted vertically. Adjustment of the vertical positioning of the tree requires adjustment of four wing nuts which must all be tightened to hold the tree vertical. The legs of the stand are independent of the gimbals mechanism. Attachment of the tree requires tightening four eye bolts.

U.S. Pat. No. 5,000,414, issued to Rosato on Mar. 19, 1991, discloses a spring biasing means to firmly hold the tree in the stand. The spring biasing means also serves to adjust the vertical position of the tree which requires at least two people to adjust the vertical position of the tree.

U.S. Pat. No. 3,661,349, issued to De Vries on May 9, 1972, discloses another gimbals mechanism to position the tree. Again, two people are required to position the tree because one cannot lock one axis independently of the other one.

U.S. Pat. No. 2,605,067, issued to Lindsell on Dec. 1, 1950, discloses an elaborate gimbaled arrangement requiring the use of bearings, counterweight tensioning means and sockets for Christmas tree bulbs as well as a rotating function. This design is prohibitively expensive to manufacture. In addition, it uses a four point thumb screw attachment method to hold the tree within the stand.

A Christmas tree stand that is inexpensive to manufacture, that permits attachment of the tree to the stand by a single clamping mechanism and, independently, permits adjustment of the vertical alignment of the tree by a single person is not found in the prior art.

OBJECTS AND ADVANTAGES

It is an object of the invention to provide a Christmas tree stand that includes a deep water reservoir capable of holding a substantial quantity of water.

It is another object of the invention to provide a Christmas tree stand that enables the user to determine the amount of water required to fill the reservoir while in a standing position.

It is another object of the invention to provide a Christmas tree stand that enables the stand to be attached to the tree with a single adjustment.

It is another object of the invention to provide a Christmas tree stand that is suitable for a wide range of tree trunk sizes and trunk variability yet firmly hold the tree using a single adjustment clamping mechanism.

Another object of the invention is to provide a Christmas tree stand that permits adjustment of the verticality of the tree independent of the mechanism that attaches the stand to the tree.

It is still another object of the invention to provide a Christmas tree stand with two mutually perpendicular verticality adjustment axes, wherein each axis can be adjusted independent of the other axis, to enable the tree to be adjusted to vertical by an individual without assistance.

A further object of the invention is to provide a Christmas tree stand that can be inexpensively manufactured.

It is a final object of the invention to provide a Christmas tree stand where most of the weight of the tree is not on the vertical adjustment mechanism so that little effort is required to place the tree in the desired position.

Still further objects and advantages will become apparent from a consideration of the ensuing description and accompanying drawings.

Reference Numerals

Figure 1:
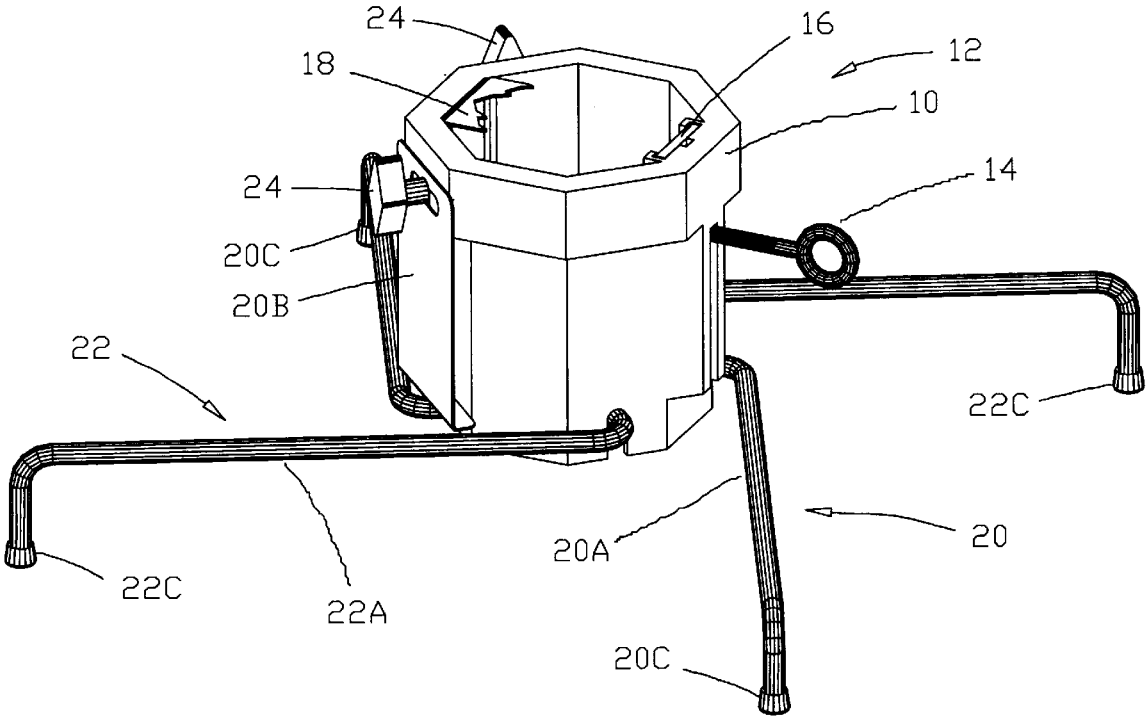
FIG. 1 is an isometric view of the improved Christmas tree stand in accordance with the invention.

| | | | |
|---|---|---|---|
| 10 | housing | 32 | bolt slot |
| 12 | clamping assembly | 34 | pivot slot |
| 14 | eyebolt | 36 | pivot slot |
| 16 | nut plate | 38 | pivot slot |
| 18 | double-V bracket | 40 | pivot slot |
| 20 | adjustment assembly, lower | 42 | projection |
| 20A | formed rod | 44 | tube |
| 20B | slotted plate | 46 | curve |
| 20C | end cap | 48 | bend |
| 20D | rod cross-member | 50 | support |
| 22 | adjustment assembly, upper | 52 | stopper |
| 22A | formed rod | 54 | tube |
| 22B | slotted plate | | |
| 22C | end cap | | |
| 22D | rod cross-member | | |
| 24 | control knob | | |
| 26 | channel | | |
| 28 | channel | | |
| 30 | bolt slot | | |

SUMMARY

A Christmas tree stand is provided that allows one person to quickly and easily attach the tree stand to the Christmas tree and adjust the tree to vertical alignment. The tree stand attachment and the tree verticality adjustment functions are totally independent of one another.

To attach the stand to the tree, the tree trunk bottom is positioned inside the tree stand housing, and a single eyebolt is turned which clamps the tree to a fixed bracket inside the tree stand housing.

To adjust the tree to vertical alignment, two locking knobs are first slightly loosened to provide controlled friction to hold the tree in whatever tilt position it is placed, and to permit positioning the tree by simply moving the tree trunk. The unique gimbal mechanism maintains stable four-point tree stand surface contact at all times in whatever position the tree is moved. Maximum tilt-angle stops limit tree tilt to prevent tilt angles which could cause the tree to tip over. Because the axes of the unique gimbal mechanism are mutually perpendicular to each other, verticality in each axis can be adjusted independent of the other axis, which allows one person to adjust the tree without requiring assistance in judging verticality. The tree is locked in the aligned position by tightening the two knobs.

A water level indicator is provided to permit convenient monitoring of the water level inside the tree stand housing, to help in preventing the fire hazard attendent with an insufficiently watered tree.

PREFERRED EMBODIMENT—DESCRIPTION

General Description—

The invention is a stand for holding a Christmas tree in a substantially vertical position. A water reservoir is provided. Bracket means, attached to said reservoir, for supporting the trunk of said tree is provided. A bolt, positioned through a bolt opening in said reservoir opposite said bracket means, is provided wherein said bolt can be clamped against the trunk of said tree, holding said tree in a firm position within said reservoir against said bracket means. Force distribution means is provided for adjustably connecting said bolt to said reservoir, for distributing the force exhibited by said bolt when it is clamped against said tree trunk. Gimbals means, adjustably attached to said reservoir, is provided for selecting the vertical alignment of said tree. Two verticality adjustment means, adjustably attached to said reservoir substantially perpendicular to one another, are provided for adjusting the position of gimbals means, with each verticality adjustment means being independently adjustable from each other, so that said stand can be moved in a plane corresponding to one verticality adjustment means while the movement of said stand in a plane corresponding to the other said verticality adjustment means is substantially fixed. An indicator is provided which will indicate the water level in said reservoir. The indicator has a first tube, having a top and bottom end, that stands substantially vertical on an outside wall of said reservoir. A second tube is provided. The second tube is smaller in diameter and has an attachment end and submerged end and a substantially U-shaped bend. The bend in the second tube is supported by a top edge of said reservoir with the submerged end positioned below the water level of said reservoir. The attachment end of said second tube is fastened within said first tube at the bottom. When a siphon is established, water will flow from said reservoir via said second tube to said first tube thereby indicating the level of water in said reservoir.

Detailed Description—

FIG. 1 is an isometric view of the improved Christmas tree stand in accordance with the invention. The housing 10 also functions as the water reservoir. Housing 10 is preferably fabricated from light weight material that has sufficient strength to support typical Christmas trees used in the home. In its preferred embodiment, housing 10 is approximately 7 inches wide and 7 inches high. This size will accommodate the size of most trees used in the home. Larger trees can be supported by merely scaling up the dimensions presented herein accordingly. Attached to the housing are the clamping assembly 12, which is comprised of eyebolt 14, nut plate 16, and the nut plate gasket (not shown). The gasket is made of rubber, is approximately the size and shape of the nut plate, and is located between the nut plate and the inner wall of the housing. Eyebolt 14, which is part of the single point tree clamping assembly 12, is used to hold cross-sectional area to minimize tree penetration. However, this size is not critical and other sizes of bolt would also be suitable. Eyebolt 14 is fed through a non-threaded hole in housing 10, located preferably approximately two inches from the top, and opposite the double-V bracket 18. The double-V bracket 18 is preferably about 4½ inches long and 3 inches wide at each "V" so that the tree will be stably held within the stand. The double-V bracket 18 is preferably set above the bottom of the reservoir by about 1½ inches so that the tree does not require a perfectly square cut on the bottom of the tree trunk. The gimbaled verticality adjustment mechanism has two essentially identical adjustment assemblies. Adjustment assembly, lower 20 is comprised of formed rod 20A, slotted plate 20B, and end caps 20C. Adjustment assembly, upper 22 is comprised of formed rod 22A, slotted plate 22B (not shown in this view), and end caps 22C. Slotted plates 20B & 22B are welded to their respective formed rods 20A & 22A. Although in the preferred embodiment each adjustment assembly consists of a rod, a slotted plate, and two end caps, the invention is not limited to this configuration. Means can be provided, for example, to make the rod portion in several sections, using standard assembly techniques, to allow packaging size to be reduced. Each adjustment assembly allows the tree to be positioned in a plane independent of the verticality positioning set by the other adjustment assembly. The two planes are substantially perpendicular to one another so that the verticality positioning is infinitely adjustable throughout the permissible range of movement. The range of permitted movement in each plane is limited, by the length of the slots in the slotted plates 20B & 22B, to approximately 7 degrees inclination left and right about center in each adjustment plane. The range of permitted movement is limited so that the user cannot tilt the tree so much as to cause it to topple over. Preferably, to ensure stability, the center of gravity of the tree must remain within the "footprint" provided by the adjustment assemblies 20 & 22.

The invention features a frictional independent locking mechanism on each adjustment assembly. Each locking mechanism is comprised of a control knob 24, a bolt (not shown), and washers (also not shown). It is the independence of each adjustment axis that allows one person to adjust the tree verticality in both axes without assistance; when facing the tree from any single position sensing left/right verticality can be done with ease, but sensing toward/away verticality is difficult. The control knob on either or both axes can be loosened slightly, enough so that the tree can be moved but tight enough so that it will not move by itself. In the preferred embodiment a spring washer is provided to set the control knob sensitivity, but this is not critical to performance. After the tree verticality is set, tightening the control knob 24 locks the position in that axis. Axes can be locked individually, or the tree can be adjusted in both axes and then both control knobs tightened.

In the preferred embodiment eyebolt 14 is located 135 degrees apart from each attached adjustment assembly, and the double-V bracket 18 is located equidistant between the adjustment assemblies 20 & 22, or approximately 45 degrees from each one, but these locations are not critical to performance because the attachment function is independent of the verticality adjustment function.

Figure 2:
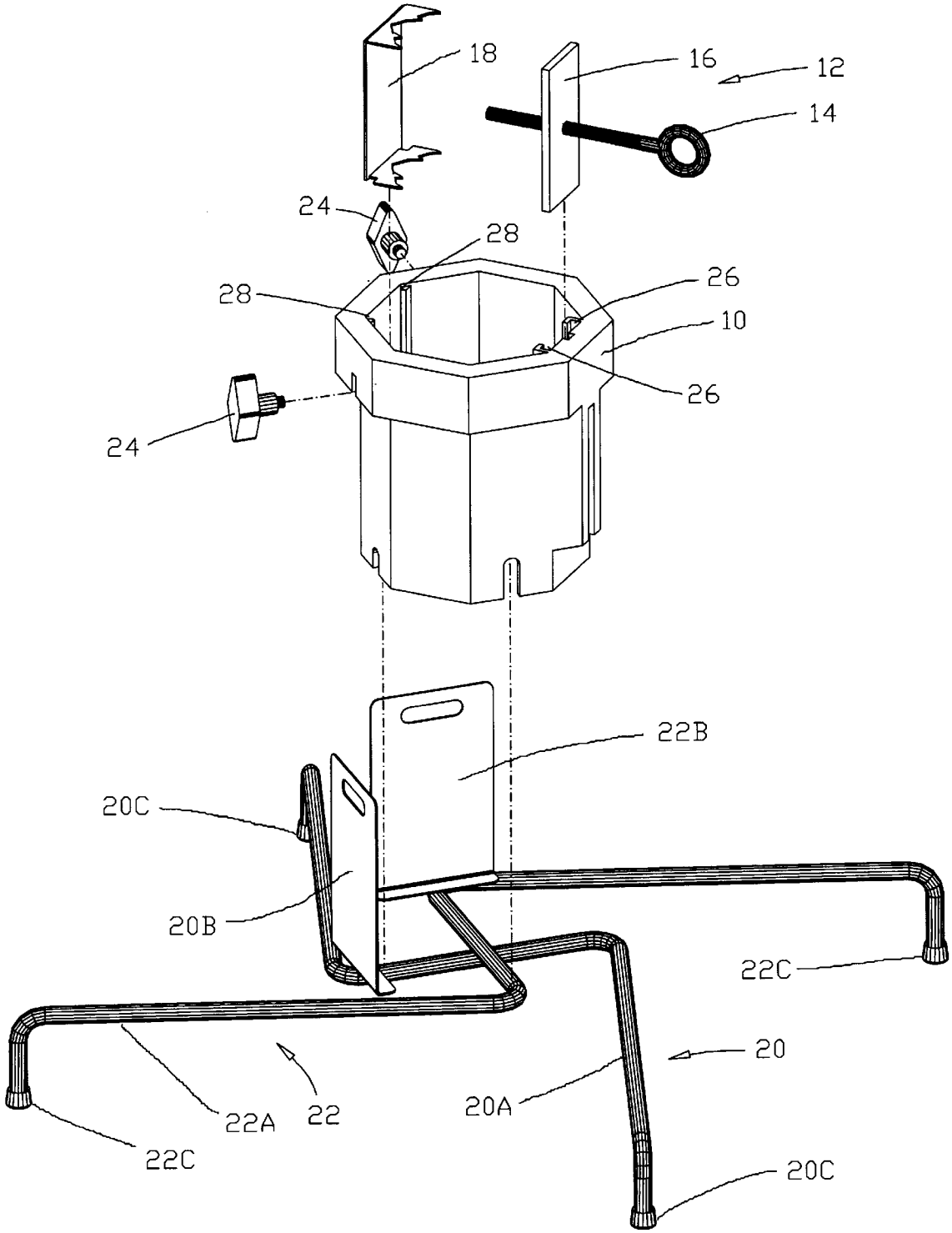
FIG. 2 is an exploded isometric view of the stand as shown in FIG. 1, looking down at the tree stand.

FIG. 2 is an exploded isometric view of the improved Christmas tree stand as shown in FIG. 1, looking down at the tree stand. Slotted plate 22B can be seen in this view, along with support channels 26, which contain the nut plate 16 and nut plate gasket (not shown), and channels 28, which contain the double-V bracket 18. Here it can be seen that adjustment assembly 20 is positioned immediately below adjustment assembly 22; in this preferred embodiment the only difference between the two adjustment assemblies 20 & 22 is that the length of the vertical sections of rod 22A are longer than the vertical sections of rod 20A by the diameter of rod 20A.

Figure 3:
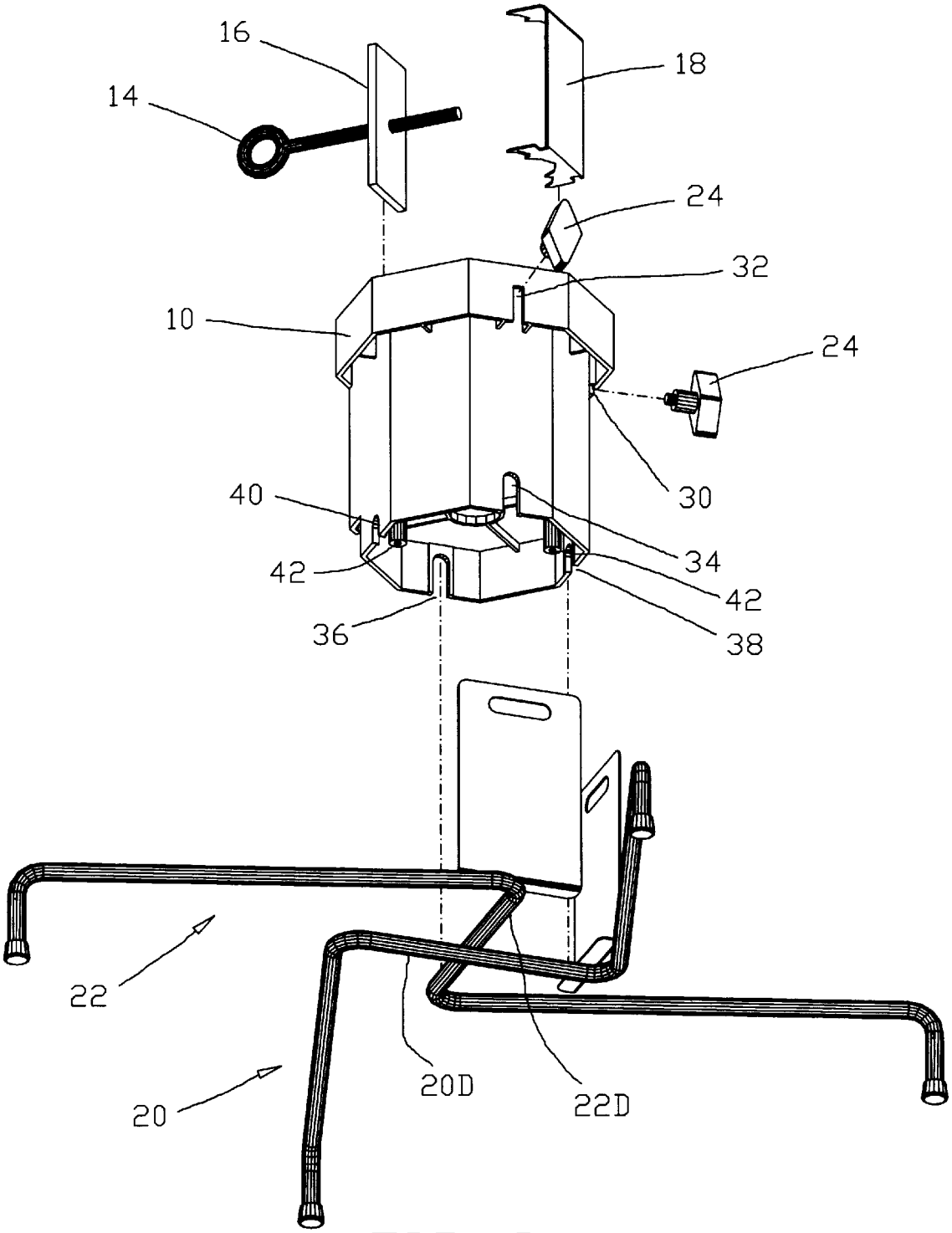
FIG. 3 is an exploded isometric view, looking up at the tree stand from the opposite side of the view shown in FIG. 2.

FIG. 3 is an exploded isometric view, looking up at the tree stand from the opposite side of the view shown in FIG. 2. This view shows bolt slot 30, which contains the bolt portion of the locking mechanism that control knob 24 is threaded onto to provide the friction and locking functions that control adjustment assembly 20. The other bolt slot 32 performs a similar function for adjustment assembly 22. The bolt heads are captured by housing 10 behind slots 30 & 32. On the bottom of housing 10 can be seen pivot slots 34 and 36, which rest on rod cross-member 22D of adjustment assembly 22, and pivot slots 38 and 40, which rest on cross-member 20D of adjustment assembly 20. Also shown are projections 42, where screws (not shown) fasten fender washers (also not shown) to capture rod cross-member 20D pivotally to housing 10.

Figure 4:
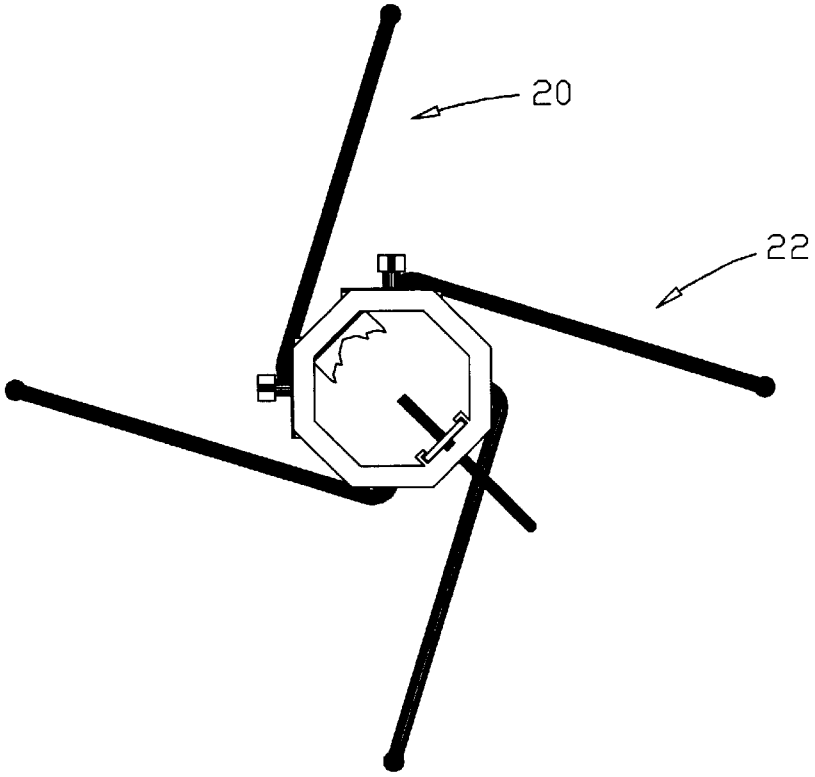
FIG. 4 is a view looking directly down at the top of the tree stand.
Figure 5:
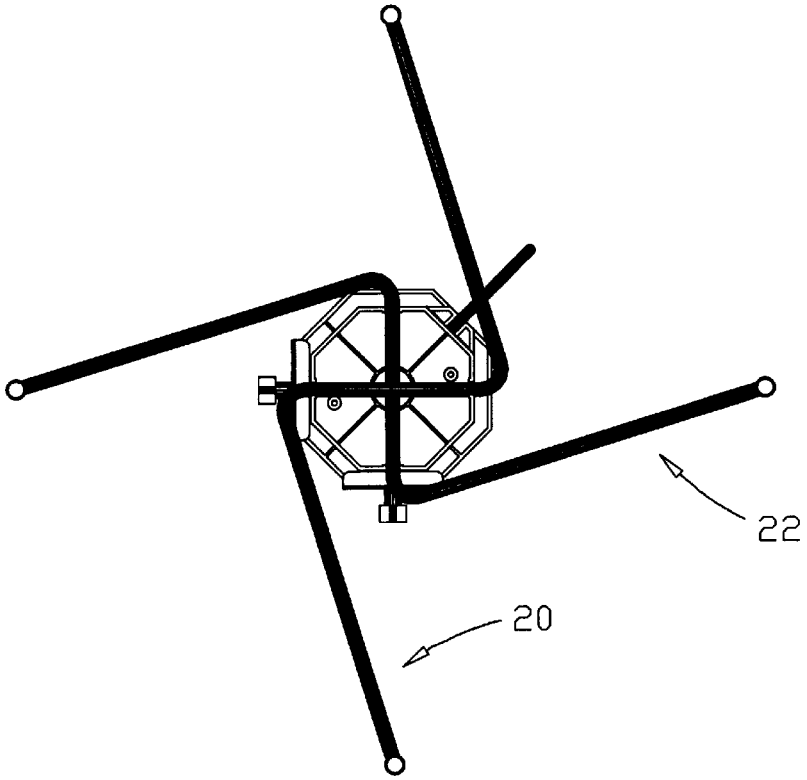
FIG. 5 is a view looking directly up at the bottom of the tree stand.

FIG. 4 is a view looking directly down at the top of the tree stand, and FIG. 5 is a similar view looking directly up at the bottom of the tree stand.

Figure 6:
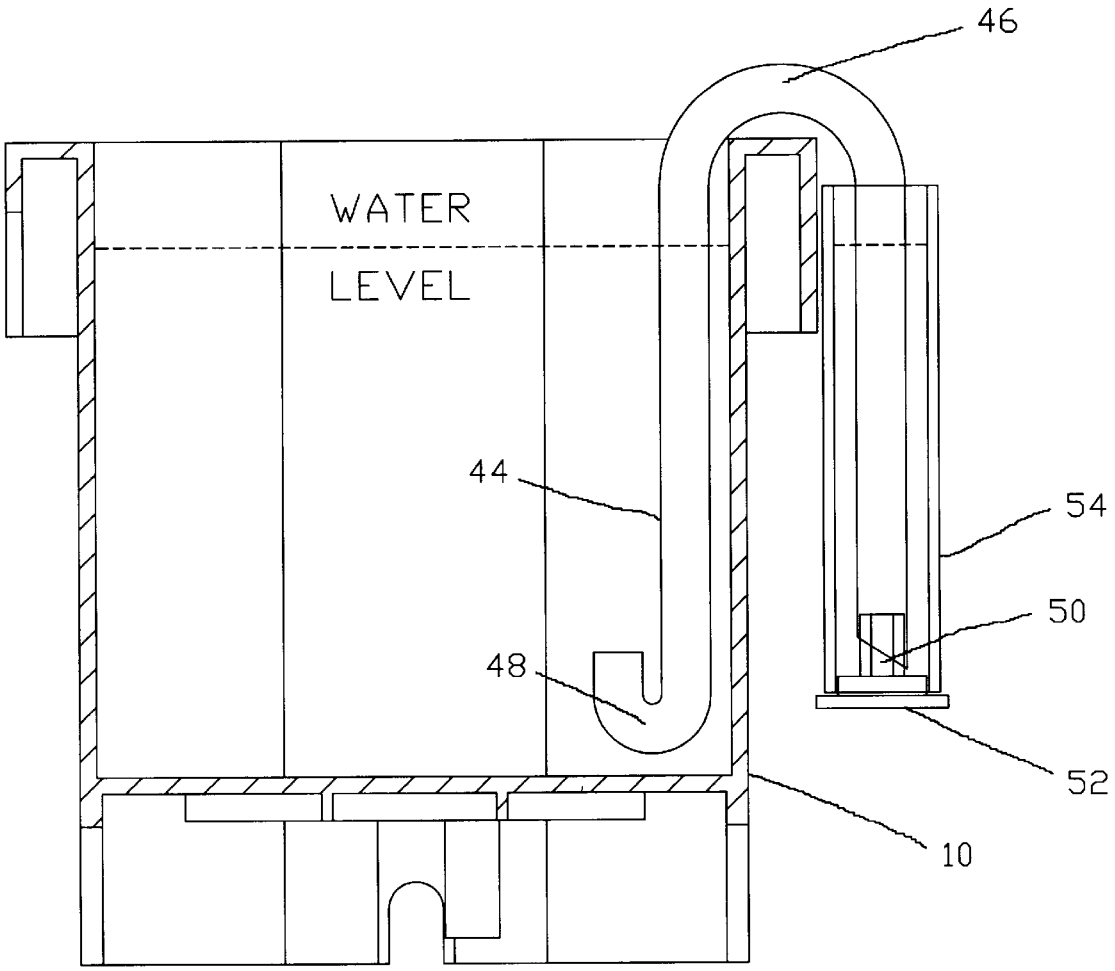
FIG. 6 is a detailed side view of the water level indicator, shown positioned on a sectional view of the housing.

FIG. 6 is a detailed side view of the water level indicator, shown positioned on a sectional view of the housing. The water level indicator is hung on housing 10 and will indicate the level of water in the reservoir when viewed from the side. Tube 44, which is preferably clear plastic, is bent with curve 46. Tube 44 could be substantially rigid and formed to achieve the shape shown. Also, flexible tubing could be used and a shape-retaining wire (not shown) inserted into tube 44 would also be acceptable. The wire could be either part of the tube itself or merely inserted in the tube opening.

The reason for curve 46 is that the indicator uses a siphon principle to operate. Bend 48 prevents any bubbles formed during immersion from reaching the top of tube 44 which might interfere with the siphon. Tube 44 is anchored on support 50 which is attached to stopper 52 but is open to tube 54, thus, water from tube 44 is free to enter tube 54. Large tube 54 must be at least partially clear so that the water level can be viewed. By filling the indicator with water including tube 44 and placing it in the filled reservoir, a siphon from the reservoir to the indicator will result, with the level of water rising in tube 54 corresponding to the level of water in the reservoir. The indicator will continue to show the level of water in the reservoir until that level drops to the end of tube 44.

PREFERRED EMBODIMENT—OPERATION

Figure 7:
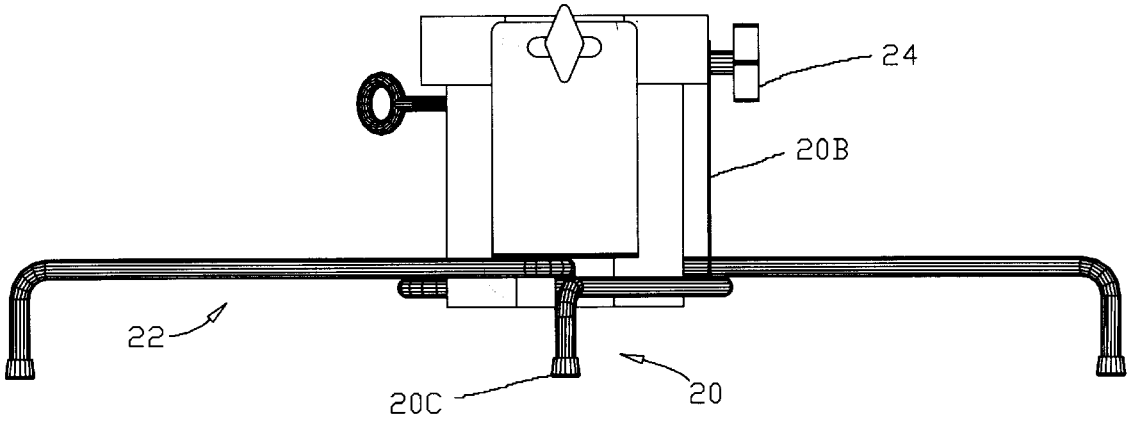
FIG. 7 is a view from ground level, looking directly at one of the tilt axes, and with the stand centered in its tilt adjustment range about that axis. The other tilt axis is locked in its center range.

FIG. 7 is a view from ground level, looking directly at the tilt axis (22D, not called out in this view) of the adjustment assembly, upper 22. This Figure, along with FIGS. 8, 9,10, 11, & 12, will demonstrate how the improved Christmas tree stand parts move, relative to one another, as the tree stand is moved through its verticality adjustment range about the axis being viewed. The other tilt axis, controlled through adjustment assembly, lower 20, is locked in the center of its tilt adjustment range and will remain locked in that position. FIG. 7 shows the housing positioned in the center of the range controlled by adjustment assembly, upper.

Figure 8:
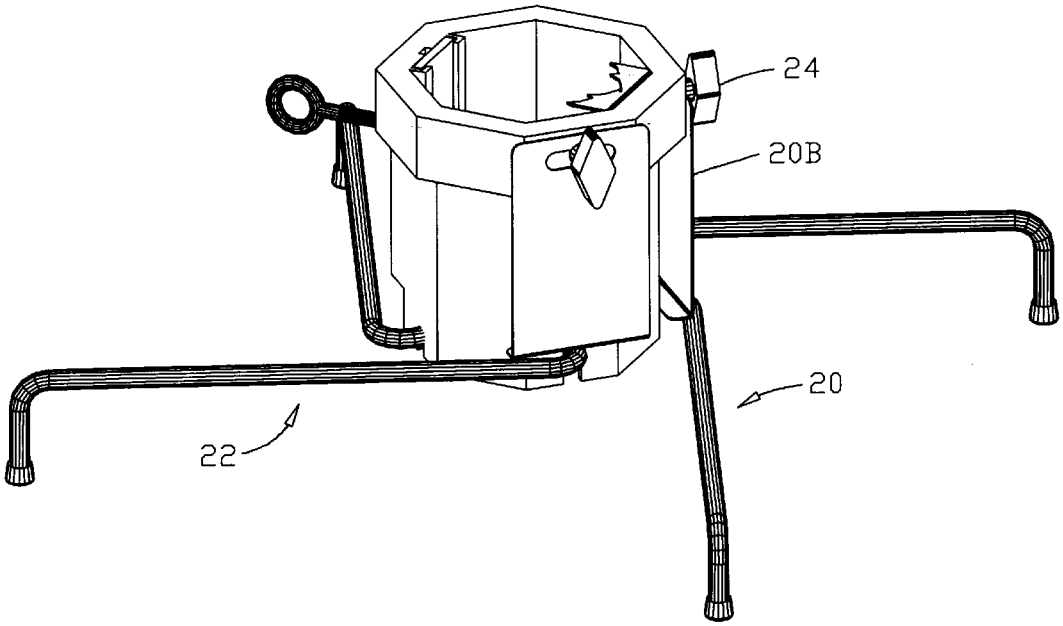
FIG. 8 is a view similar to FIG. 7, but from slightly above ground level and slightly to the left of the tilt axis.

FIG. 8 is a view similar to FIG. 7, but from slightly above ground level and slightly to the left of the tilt axis being demonstrated. This view will be repeated in FIGS. 10 & 12, for each of the extremes of motion to the limits of tilt right and left that will be demonstrated in FIGS. 9 & 11; among other things, this view demonstrates that adjustment assembly, lower 20 remains locked as is exemplified by the positional relationship of slotted plate 20B and control knob 24.

Figure 9:
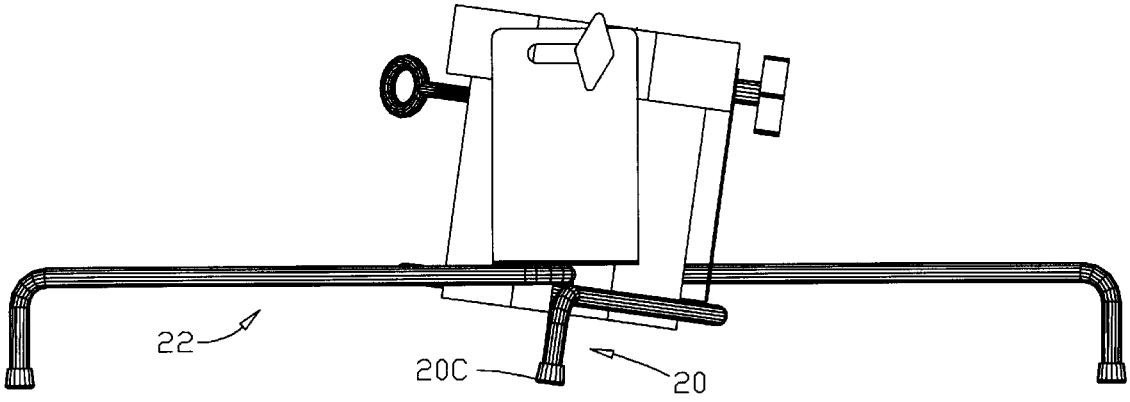
FIG. 9 is a view identical to FIG. 7, but with the tree stand housing tilted to the maximum right-tilt end of the tilt adjustment range. The other tilt axis remains locked at center range.

FIG. 9, a view identical to FIG. 7, shows the housing tilted right to the limit of permissible travel. Notice that as the housing tilts about the axis being viewed head on [that of the adjustment assembly, (upper)], the entire other adjustment assembly, (lower) tilts along with the housing. During the time the housing is in the process of being tilted about the axis of adjustment assembly, upper 22, the end caps 20C on adjustment assembly, lower 20 experience a small amount of slipping on the surface they are contacting, in a direction opposite to the direction of movement of the top of the housing. The rounded bottom surfaces of all end caps are shaped to maintain surface contact at all inclinations of the adjustment assemblies.

Figure 10:
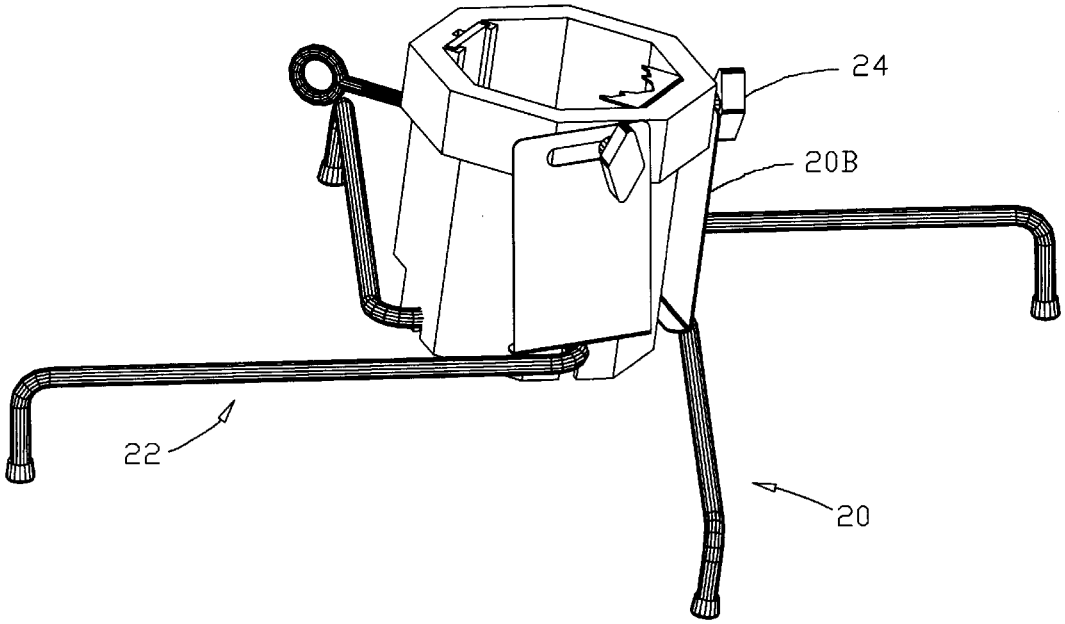
FIG. 10 is a view of FIG. 9 identical to the viewing position of FIG. 8.

FIG. 10 shows that control knob 24 remains locked in position on slotted plate 20B.

Figure 11:
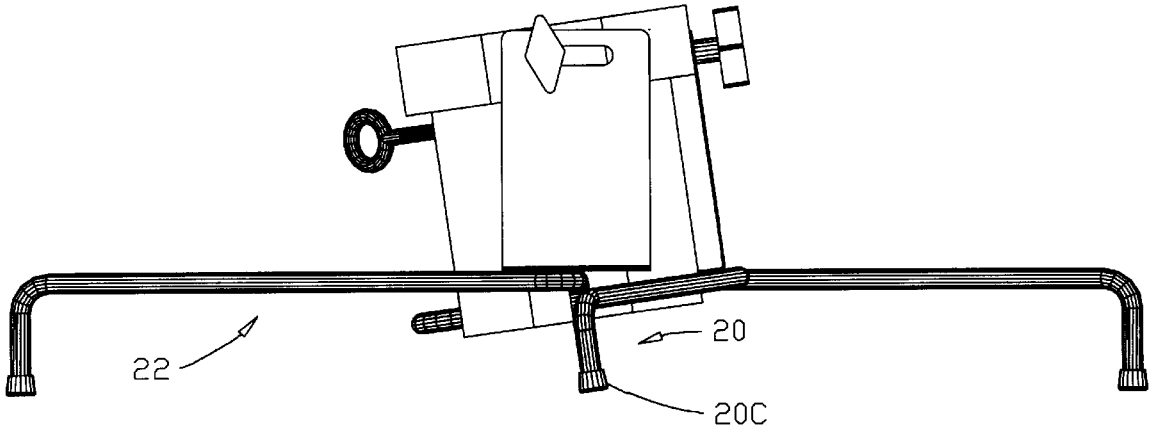
FIG. 11 is a view identical to FIG. 7, but with the tree stand housing tilted to the maximum left-tilt end of the tilt adjustment range. The other tilt axis remains locked at center range.

FIG. 11, a view also identical to FIG. 7, shows the housing tilted left to the limit of permissible travel. Notice that, here again, the end caps 20C experience a small amount of slipping in a direction opposite to the direction of movement of the top of the housing.

Figure 12:
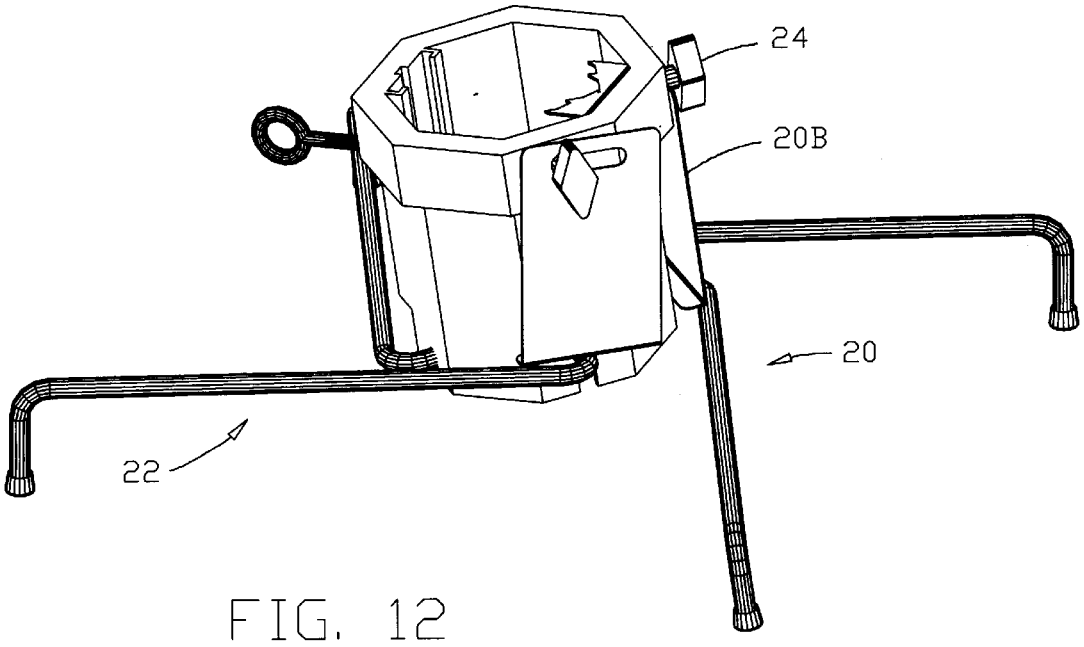
FIG. 12 is a view of FIG. 11 identical to the viewing position of FIG. 8.

FIG. 12 shows that control knob 24 remains locked in position on slotted plate 20B.

Conclusions, Ramifications, and Scope

Accordingly, it can be seen that an easily attachable and adjustable Christmas tree stand is provided. A water level indicator is also provided to monitor the status of water in the reservoir to ensure an adequate water supply is available to minimize fire hazard due to an inadequately watered tree. The attachment of the stand to the tree is accomplished by tightening a single eyebolt. The tree verticality adjustment mechanism permits independent adjustment in two mutually perpendicular planes, independently lockable, with friction control knob adjustment capability to hold the tree in an adjusted position in either plane while the tree can by adjusted in either plane.

Although the description above contains many specificities, these should not be construed as limiting the scope of the invention but as merely providing illustrations of some of the presently preferred embodiments of this invention. Various other embodiments and ramifications are possible within it's scope. For example, the unique gimbal mechanism arrangement can be used to provide independent axis control in other positioning adjustment applications. It is obvious that with rods formed to make the tilt axes planar, and with rod ends aligned perpendicular to their respective tilt axes instead of formed 90 degrees downward as in the Christmas tree stand embodiment, a simple gimbal mechanism with independent axis control is formed, and any platform application requiring such control can benefit.

Thus the scope of the invention should be determined by the appended claims and their legal equivalents, rather than by the examples given.

What is claimed is:

1. A stand for holding a Christmas tree in a substantially vertical position with said tree having a trunk, said stand comprising:

a water reservoir;

bracket means, attached to said reservoir, for supporting the trunk of said tree;

a bolt, positioned through a bolt opening in said reservoir opposite said bracket means, wherein said bolt can be clamped against the trunk of said tree, holding said tree in a firm position within said reservoir against said bracket means;

force distribution means, adjustably connecting said bolt to said reservoir, for distributing the force exhibited by said bolt when it is clamped against said tree trunk;

gimbals means, adjustably attached to said reservoir, for selecting the vertical alignment of said tree, wherein said gimbals means further comprises two verticality adjustment means, adjustably attached to said reservoir substantially perpendicular to one another, for adjusting the position of gimbals means, with each verticality adjustment means being independently adjustable from each other, so that said stand can be moved in a plane corresponding to one verticality adjustment means while the movement of said stand in a plane corresponding to the other said verticality adjustment means is substantially fixed.

2. The stand of claim 1 wherein said force distribution means further comprises sealing means for sealing said bolt opening against water leaks when said bolt is clamped against the trunk of the tree.

3. The stand of claim 2 wherein said sealing means further comprises a compressible gasket surrounding said bolt such that force against said bolt causes said force distribution means to compress said gasket against the said bolt and said reservoir thereby preventing water to leak through said bolt opening.

4. The stand of claim 3 further comprising an indicator which will indicate the water level in said reservoir.

5. The stand of claim 4 wherein said indicator further comprises a first tube, having a top and bottom end, that stands substantially vertical on an outside wall of said reservoir and a second tube, smaller in diameter and having an attachment end and submerged end and a substantially U-shaped bend with said bend being supported by a top edge of said reservoir with the submerged end positioned below the water level of said reservoir and the attachment end of said second tube fastened within said first tube at the bottom such when a siphon is established, water will flow from said reservoir via said second tube to said first tube thereby indicating the level of water in said reservoir.

6. A stand for holding and adjusting the position of an object, said stand comprising:

means for holding said object;

attachment means for attaching said object to said holding means;

gimbals means, adjustably attached to said holding means for selecting the positioning of said object;

wherein said gimbals means further comprises two positioning adjustment means, adjustably attached to said holding means substantially perpendicular to one another, for adjusting the position of said gimbals means, with each adjustment means being independently adjustable from each other, so that said holding means can be moved in a plane corresponding to one adjustment means while the movement of said holding means in a plane corresponding to the other said adjustment means is substantially fixed.

7. The stand of claim 6 wherein said object is a Christmas tree having a trunk and wherein said holding means is a housing that further comprises a water reservoir.

8. The stand of claim 7 further comprising:

bracket means, attached to said housing, for supporting the trunk of said tree.

9. The stand of claim 8 further comprising:

a bolt, positioned through a bolt opening in said reservoir opposite said bracket means, wherein said bolt can be clamped against the trunk of said tree, holding said tree in a firm position within said housing against said bracket means.

10. The stand of claim 9 further comprising:

force distribution means, adjustably connecting said bolt to said housing, for distributing the force exhibited by said bolt when it is clamped against said tree trunk.

11. The stand of claim 10 further comprising:

gimbals means, adjustably attached to said housing, for selecting the vertical alignment of said tree.

12. The stand of claim 11 wherein said gimbals means further comprises two verticality adjustment means, adjustably attached to said housing substantially perpendicular to one another, for adjusting the position of gimbals means, with each verticality adjustment means being independently adjustable from each other, so that said housing can be moved in a plane corresponding to one verticality adjustment means while the movement of said housing in a plane corresponding to the other said verticality adjustment means is substantially fixed.

13. The stand of claim 12 wherein said force distribution means further comprises sealing means for sealing said bolt opening against water leaks when said bolt is clamped against the trunk of the tree.

14. The stand of claim 13 wherein said sealing means further comprises a compressible gasket member surrounding said bolt such that force against said bolt causes said force distribution means to compress said gasket member against the said bolt and said housing thereby preventing water to leak through said bolt opening.

15. The stand of claim 14 further comprising an indicator which will indicate the water level in said reservoir.

16. The stand of claim 15 wherein said indicator further comprises a first tube, having a top and bottom end, that stands substantially vertical on an outside wall of said reservoir and a second tube, smaller in diameter and having an attachment end and submerged end and a substantially U-shaped bend with said bend being supported by a top edge of said reservoir with the submerged end positioned below the water level of said reservoir and the attachment end of said second tube fastened within said first tube at the bottom such when a siphon is established, water will flow from said reservoir via said second tube to said first tube thereby indicating the level of water in said reservoir.

* * * * *